US009416947B2

(12) United States Patent
Guo et al.

(10) Patent No.: US 9,416,947 B2
(45) Date of Patent: Aug. 16, 2016

(54) CONNECTING DEVICE FOR LIGHT FIXTURES

(71) Applicants: WAC Lighting (Dongguan) Co., Ltd., Dongguan, Guangdong (CN); WAC Lighting CO

(72) Inventors: Roger Guo, Dongguan (CN); Jay Hu, Dongguan (CN); Erdener Basar, Dongguan (CN)

(73) Assignees: WAC LIGHTING (DONGGUAN) CO., LTD., Dongguan, Guangdong (CN); WAC LIGHTING CO, Port Washington, NY (US)

( * ) Notice: Subject to any disclaimer, the term of this patent is extended or adjusted under 35 U.S.C. 154(b) by 0 days.

(21) Appl. No.: 14/366,725

(22) PCT Filed: Mar. 28, 2013

(86) PCT No.: PCT/CN2013/073369

§ 371 (c)(1),
(2) Date: Jun. 19, 2014

(87) PCT Pub. No.: WO2014/153754

PCT Pub. Date: Oct. 2, 2014

(65) Prior Publication Data

US 2016/0018088 A1 Jan. 21, 2016

(51) Int. Cl.

| | |
|---|---|
| ***F21V 17/00*** | (2006.01) |
| ***F21V 17/16*** | (2006.01) |
| ***F21V 23/06*** | (2006.01) |
| ***F21V 21/00*** | (2006.01) |
| ***F21V 17/06*** | (2006.01) |
| *F21V 5/00* | (2015.01) |
| *F21V 5/04* | (2006.01) |

(Continued)

(52) U.S. Cl.

CPC ..... *F21V 17/164* (2013.01); *F21V 17/06* (2013.01); *F21V 17/16* (2013.01); *F21V 21/00* (2013.01); *F21V 23/06* (2013.01); *F21V 5/007* (2013.01); *F21V 5/04* (2013.01); *F21Y 2101/02* (2013.01); *F21Y 2105/001* (2013.01)

(58) Field of Classification Search

CPC ..... F21V 17/164; F21V 17/06; F21V 23/06; F21V 21/00

USPC ..... 362/455

See application file for complete search history.

(56) References Cited

U.S. PATENT DOCUMENTS 5,964,518 A * 10/1999 Shen ..... F21V 21/005 362/217.16

6,280,052 B1 * 8/2001 White ..... F21S 2/00 362/223

(Continued)

*Primary Examiner* — Robert May

*Assistant Examiner* — Bryon T Gyllstrom

(74) *Attorney, Agent, or Firm* — Jackson IPG PLLC; Demian K. Jackson

(57) ABSTRACT

A connecting device for light fixtures has a lens fixing plate, a light fixture assembly, a button, a first spring, a connecting rod and a buckle. The buckle is fixedly connected to the light fixture assembly. A mounting base is disposed on the lens fixing plate. One end of the connecting rod is located in an inner cavity of the mounting base and the other end thereof is extended out from the mounting base. The end of the connecting rod extending out from the mounting base is provided with a boss, and the connecting rod located in the inner cavity of the mounting base is sleeved with the first spring. The button is connected to the end of the connecting rod located in the inner cavity of the mounting base.

9 Claims, 9 Drawing Sheets

(51) Int. Cl.
*F21Y 101/02* (2006.01)
*F21Y 105/00* (2016.01)

(56) References Cited

U.S. PATENT DOCUMENTS 6,671,108 B2 * 12/2003 Koiwai ..... G02B 7/02 353/100
2002/0027781 A1 * 3/2002 Agro ..... F21S 8/06 362/255
2006/0007689 A1 * 1/2006 Okabe ..... B60Q 3/0203 362/351
2010/0309672 A1 * 12/2010 Hsieh ..... F21V 17/164 362/396
2011/0058387 A1 * 3/2011 Matsunaga ..... F21K 9/00 362/547
2013/0215356 A1 * 8/2013 Yu ..... G02B 6/0088 349/58
2013/0258682 A1 * 10/2013 Pino ..... H01R 13/5219 362/382
2014/0009907 A1 * 1/2014 Wu ..... G02F 1/133308 362/97.1

* cited by examiner

CONNECTING DEVICE FOR LIGHT FIXTURES

FIELD OF THE INVENTION

The invention relates to the technical field of light fixtures, and particularly to a connecting device for light fixtures.

BACKGROUND OF THE INVENTION

In square LED track light fixtures in the prior art, a lens fixing plate and a light fixture assembly are connected to each other, generally fixedly connected by screws or by elastic sheets sometimes. Connecting the lens fixing plate with the light fixture assembly by screws or elastic sheets causes inconvenience in mounting and dismounting. As a result, the lens fixing plate and the light fixture assembly must be mounted or dismounted by tools or by a large force. Connecting the lens fixing plate with the light fixture assembly by screws or elastic sheets cannot play a role of light compensation to the light fixtures, that is, a lens mounted on the lens fixing plate cannot be in close contact with an LED light source mounted on an LED light source mounting plate of the light fixture assembly, resulting in low luminous efficiency of the light fixtures. With the continuous development of society and the continuous progress of science and technology, LED light fixtures are constantly upgrading, and people put forward new and higher requirements to the LED light fixtures in the prior art. Therefore, there is an urgent need to develop a connecting device for light fixtures, which is simple in structure and convenient in mounting and dismounting, has good light compensation, and enables the light fixtures to achieve maximum luminous efficiency.

SUMMARY OF THE INVENTION

The technical problem to be solved by the present invention is to provide a connecting device for light fixtures, in order to overcome the defects of LED light fixtures in the prior art that connecting the lens fixing plate with the light fixture assembly by screws or elastic sheets causes inconvenience in mounting and dismounting, no compensation function and low luminous efficiency of the light fixtures, as well as to meet people's aspirations and the market requirements on the connecting device for light fixtures. Such a connecting device for light fixtures is simple in structure and convenient in mounting and dismounting, has good light compensation, and enables the light fixtures to achieve maximum luminous efficiency. In addition, such a connecting device for light fixtures further has the advantages of less production procedures and low production cost, thus promising the manufacturing enterprises with good economic benefits.

The present invention employs the following technical solution to solve the above technical problem. A connecting device for light fixtures is provided, including a lens fixing plate, a light fixture assembly, a button, a first spring, a connecting rod and a buckle, the buckle being fixedly connected to the light fixture assembly; a mounting base being disposed on the lens fixing plate, one end of the connecting rod being located in an inner cavity of the mounting base and the other end thereof being extended out from the mounting base, the end of the connecting rod extending out from the mounting base being provided with a boss and the connecting rod located in the inner cavity of the mounting base being sleeved with the first spring, the button being connected to the end of the connecting rod located in the inner cavity of the mounting base, one end of the first spring being resisted against the button and the other end thereof being resisted against an end wall of the inner cavity of the mounting base; the buckle including a housing, a second spring, an inner combined sliding stopper and a transmission assembly; the housing including a front panel, a left side plate, a rear panel, a right side plate and a lower soleplate connected integrally; the inner combined sliding stopper being consisted of a sliding mounting member and a combined elastic fastener connected integrally; the transmission assembly including a connecting rod provided with a contact handle at one end and a sliding handle at the other end, the contact handle being mounted on the sliding mounting member, a sliding chute being penetrated through the rear panel of the housing, the sliding handle being clamped into the sliding chute, one end of the second spring being resisted against the contact handle while the other end thereof being resisted against the inner surface of the lower soleplate of the housing; and, the inner combined sliding stopper can slide back and forth inside the cavity of the housing through the transmission assembly, the boss being clamped by the combined elastic fastener.

Further, a spring positioning column, onto which the second spring is sleeved, is disposed on the inner surface of the lower soleplate of the housing.

Further, a fixture block is disposed on the side of the sliding mounting member and a sliding neck is penetrated through the front panel of the housing, the fixture block being in sliding connection to the sliding neck.

Further, on the inner side of the rear panel of the housing, a guide bump playing a role of guiding and a limiting bump playing a role of limiting are disposed on the sliding chute, the guide bump and the limiting bump being arranged opposite to each other.

Further, the sliding chute is in a shape of a hook, including a first bent segment, a second bent segment and a third bent segment connected in turn, the shape of the lower edge of the guide bump being the same as that of the upper edge of the sliding chute, the shape of the upper edge of the limiting bump being the same as that of the lower edge of the sliding chute.

Further, a mounting vacancy is reserved on the sliding mounting member, the contact handle being mounted in the mounting vacancy on the sliding mounting member, the connecting rod being located between the sliding mounting member and the inner surface of the rear panel.

Further, the combined elastic fastener consists of two elastic fasteners.

Further, the sliding handle is cylindrical.

Further, the surface of the contact handle resisted against the second spring is a curved surface.

The present invention has the following beneficial effects. 1. The connecting device for light fixtures provided by the present invention is convenient in mounting and dismounting. When the lens fixing plate and the light fixture assembly connected to each other, the lens fixing plate is put into the light fixture assembly, and the connecting rod is pushed to be fixedly connected to the buckle once the button on the lens fixing plate is pressed down by a hand. While the connecting rod is clamped by the buckle, the lens fixing plate is pushed under the action of the first spring to enable the lens mounted on the lens fixing plate to be in good and gapless fit with the LED light source mounted on the LED light source mounting plate of the light fixture assembly, thereby enabling the light fixtures to achieve maximum luminous efficiency. When the lens fixing plate is to be dismounted from the light fixture assembly, the connecting rod is pushed by the button and then retracted from the buckle so long as the button on the lens fixing plate is pressed down by a hand, that is, the lens fixing plate is dismounted. From the above description, it is concluded that such a connecting device for light fixtures is quite convenient in mounting and dismounting. 2. The connecting device for light fixtures provided by the present invention can play a role of light compensation to the light fixtures, that is, the lens mounted on the lens fixing plate can be in close and gapless contact with the LED light source mounted on the LED light source mounting plate of the light fixture assembly, thereby enabling the light fixtures to achieve maximum luminous efficiency. 3. The connecting device for light fixtures provided by the present invention has the advantages of simple structure, less production procedures and low production cost, thus promising the manufacturing enterprises with good economic benefits. 4. The connecting device for light fixtures provided by the present invention has a wide scope of application, and can be applicable to connection between components in various light fixtures. Moreover, by such a connecting device, the components may be mounted and dismounted conveniently. 5. During the production and use, no waste water, waste gas or waste residue will be generated and it is thus environmentally friendly. 6. The connecting device for light fixtures provided by the present invention has the advantages of rational design, strong practicality and broad market prospects.

DETAILED DESCRIPTION OF THE PREFERRED EMBODIMENTS

Figure 1:
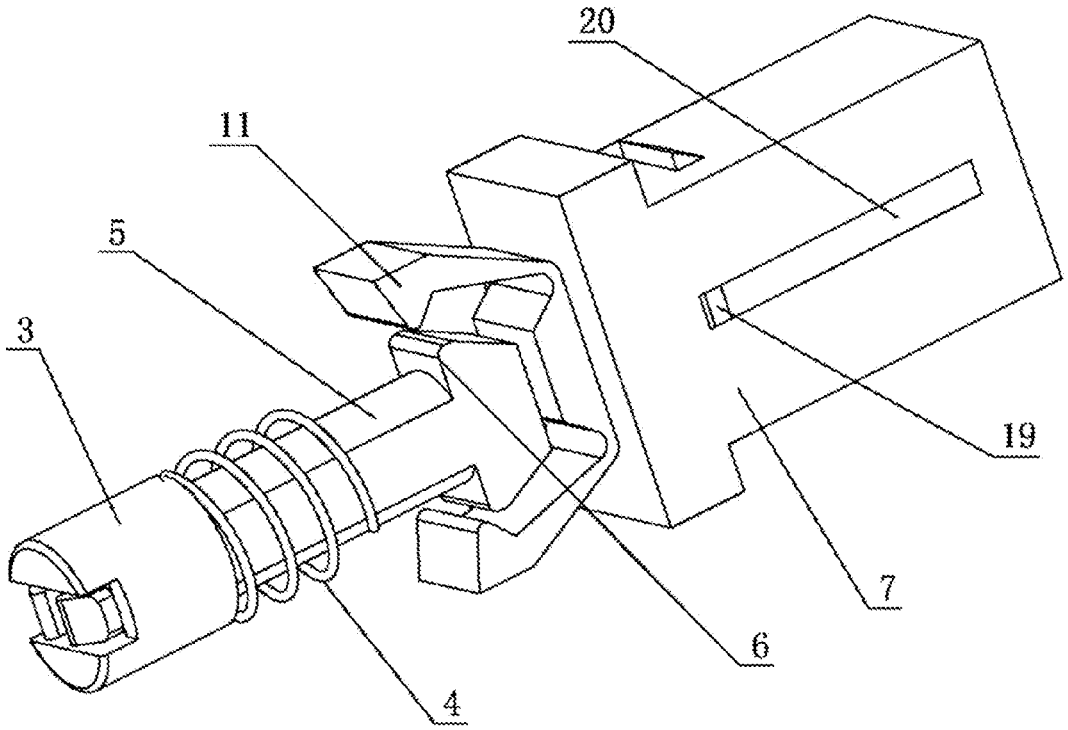
FIG. 1 is a stereoscopic structure diagram of part of components according to the present invention.
Figure 2:
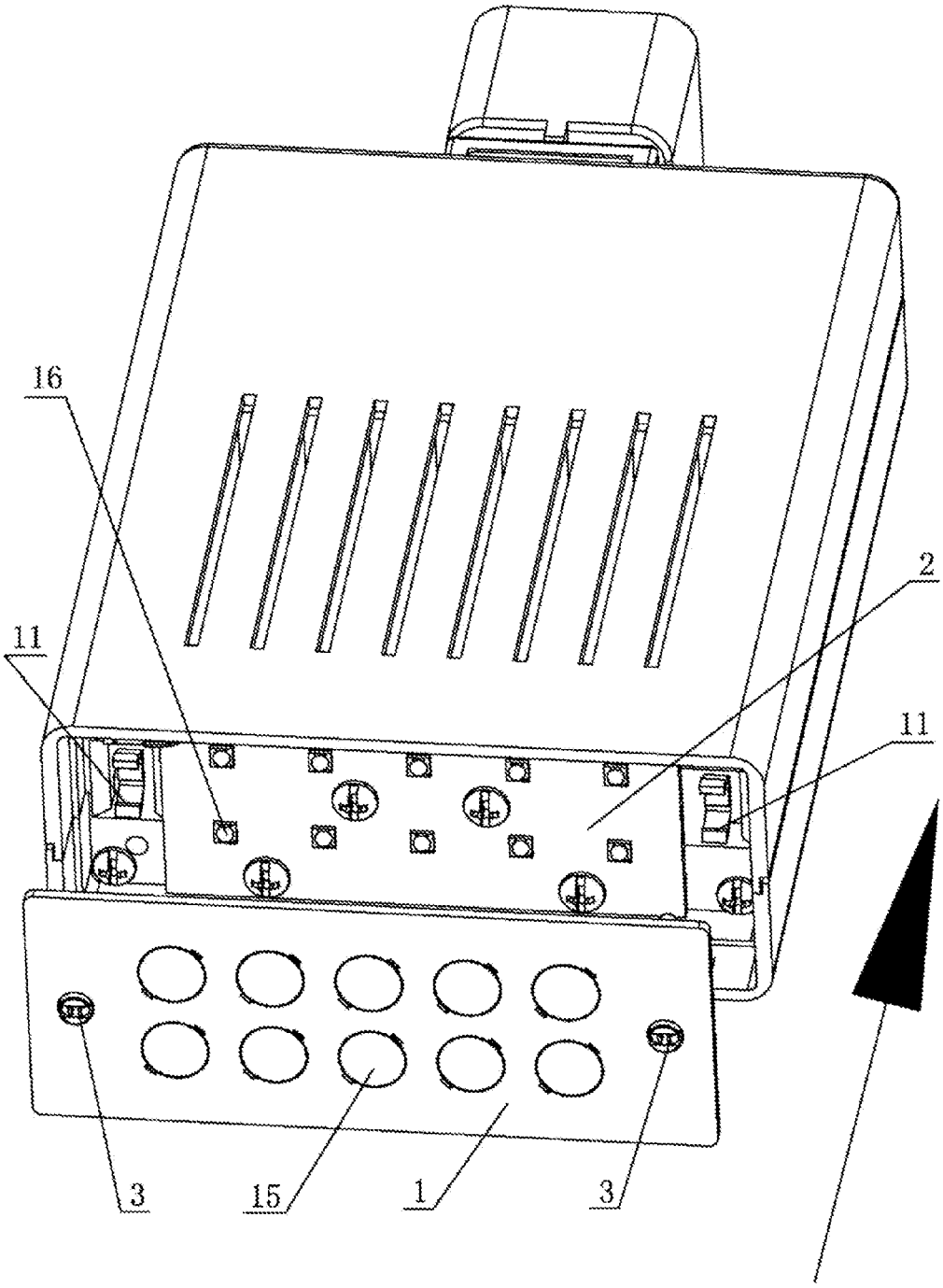
FIG. 2 is a schematic diagram of part of the components and light fixtures according to the present invention during mounting, in which the direction shown as the arrow is a direction for mounting a lens fixing plate.
Figure 3:
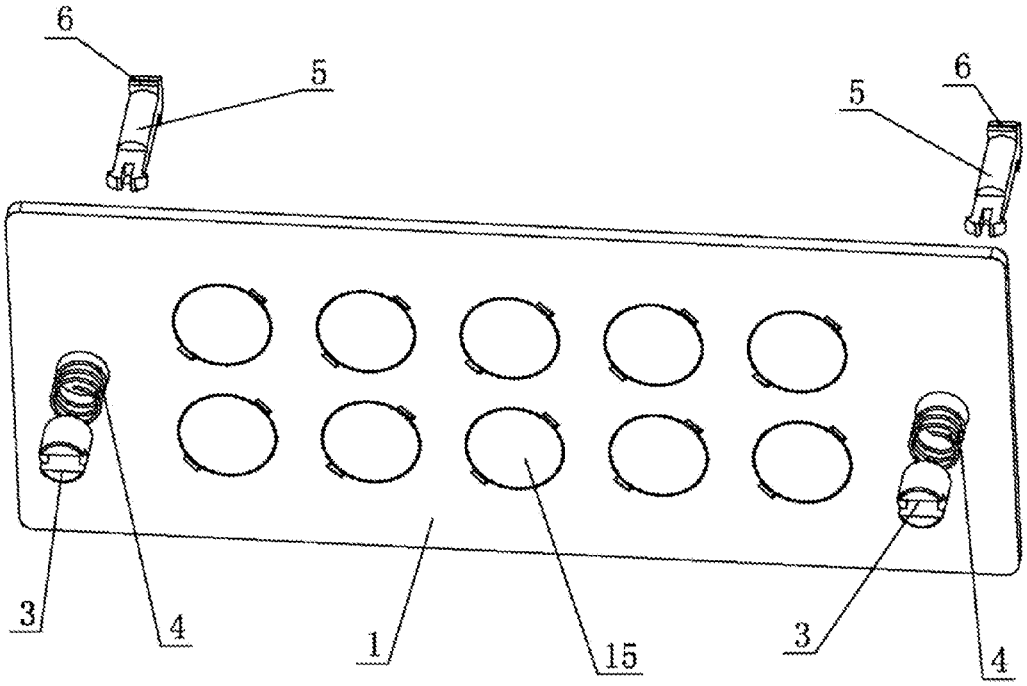
FIG. 3 is a schematic diagram of part of the components and the lens fixing plate in the light fixtures according to the present invention during mounting.
Figure 4:
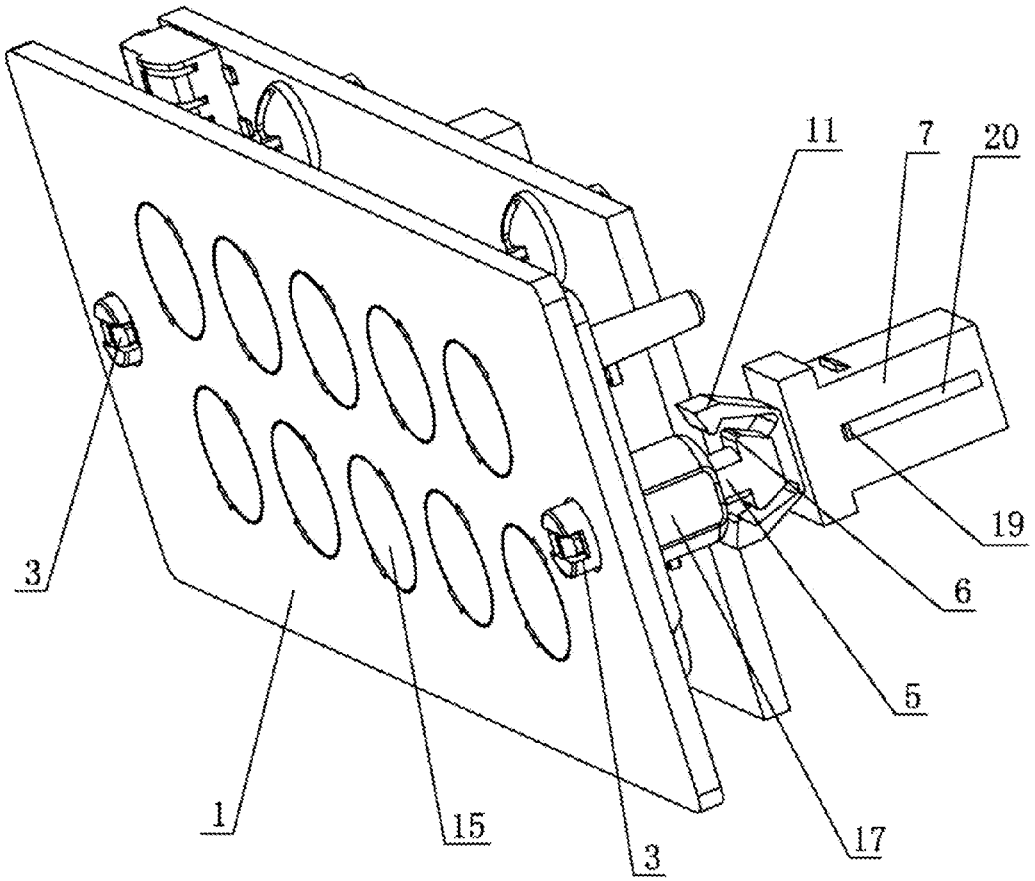
FIG. 4 is a schematic diagram of part of the components and the lens fixing plate in the light fixtures according to the present invention during mounting, from another view.

The present invention will be further described as below in details with reference to the accompanying drawings and specific embodiments. However, the scope of implementation of the present invention is not limited thereto.

As shown in FIGS. 1-4, a connecting device for light fixtures according to an embodiment of the present invention is provided, including a lens fixing plate 1 and a light fixture assembly 2. Multiple lenses 15 are mounted on the lens fixing plate 1, and multiple LED light sources 16 are mounted on an LED light source mounting plate of the light fixture assembly 2. When the lens fixing plate 1 is connected to the light fixture assembly 2, the lenses 15 and the LED light sources 16 are arranged correspondingly one by one. The connecting device for light fixtures further includes a button 3, a first spring 4, a connecting rod 5 and a buckle. The buckle is fixedly connected to the light fixture assembly 2. A mounting base 17 is disposed on the lens fixing plate 1. One end of the connecting rod 5 is located in an inner cavity of the mounting base 17 while the other end thereof is extended out from the mounting base 17. The end of the connecting rod 5 extending out from the mounting base 17 is provided with a boss 6 while the connecting rod 5 located in the inner cavity of the mounting base 17 is sleeved with the first spring 4. The button 3 is connected to the end of the connecting rod 5 located in the inner cavity of the mounting base 17. One end of the first spring 4 is resisted against the button 3 while the other end thereof is resisted against an end wall of the inner cavity of the mounting base 17. As shown in FIGS. 5-9, the buckle includes a housing, a second spring 9, an inner combined sliding stopper and a transmission assembly; the housing includes a front panel 7, a left side plate, a rear panel 21, a right side plate and a lower soleplate connected integrally; and the inner combined sliding stopper consists of a sliding mounting member 10 and a combined elastic fastener 11 connected integrally. The combined elastic fastener 11 is used for clamping the boss 6, and the transmission assembly and the sliding mounting member 10 are mounted together. The sliding mounting member 10 of the inner combined sliding stopper is mounted in the housing in a manner of sliding. When the sliding mounting member 10 slides upwards in the housing, the combined elastic fastener 11 integrally connected to the sliding mounting member 10 is extended out from the housing (the boss 6 is retreated from the combined elastic fastener 11). When the sliding mounting member 10 slides downwards in the housing, the combined elastic fastener 11 gets into the housing (the boss 6 is clamped by the combined elastic fastener 11). The combined elastic fastener 11 consists of two elastic fasteners not only capable of unfolding, but also folding. The transmission assembly includes a connecting rod 13 provided with a contact handle 12 at one end and a sliding handle 14 at the other end, and the connecting rod 13 is located between the sliding mounting member 10 and the inner surface of the rear panel 21. The contact handle 12 is mounted on the sliding mounting member 10. A mounting vacancy is reserved on the sliding mounting member 10, and the contact handle 12 is mounted in the mounting vacancy on the sliding mounting member 10. A sliding chute 8 is penetrated through the rear panel 21 of the housing, and the sliding handle 14 is clamped into the sliding chute 8. One end of the second spring 9 is resisted against the contact handle 12 while the other end thereof is resisted against the inner surface of the lower soleplate of the housing. The surface of the contact handle 12 resisted against the second spring 9 is a curved surface. The inner combined sliding stopper can slide back and forth inside the cavity of the housing through the transmission assembly, and the boss 6 is clamped by the combined elastic fastener 11. The sliding handle 14 is cylindrical.

Figure 6:
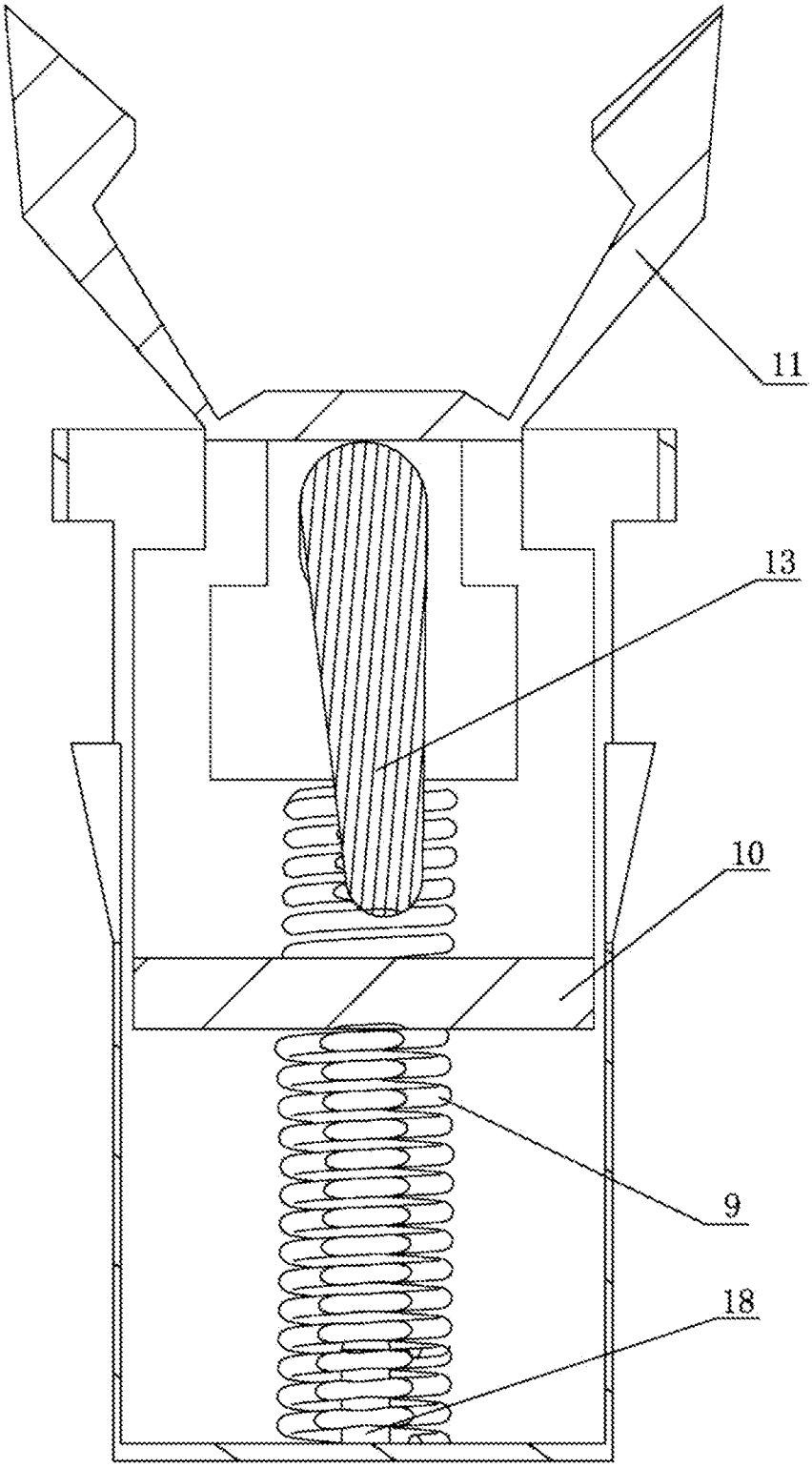
FIG. 6 is a sectional view of the buckle according to the present invention, when no stress is applied to the second spring and the combined elastic fastener is located outside the housing.
Figure 7:
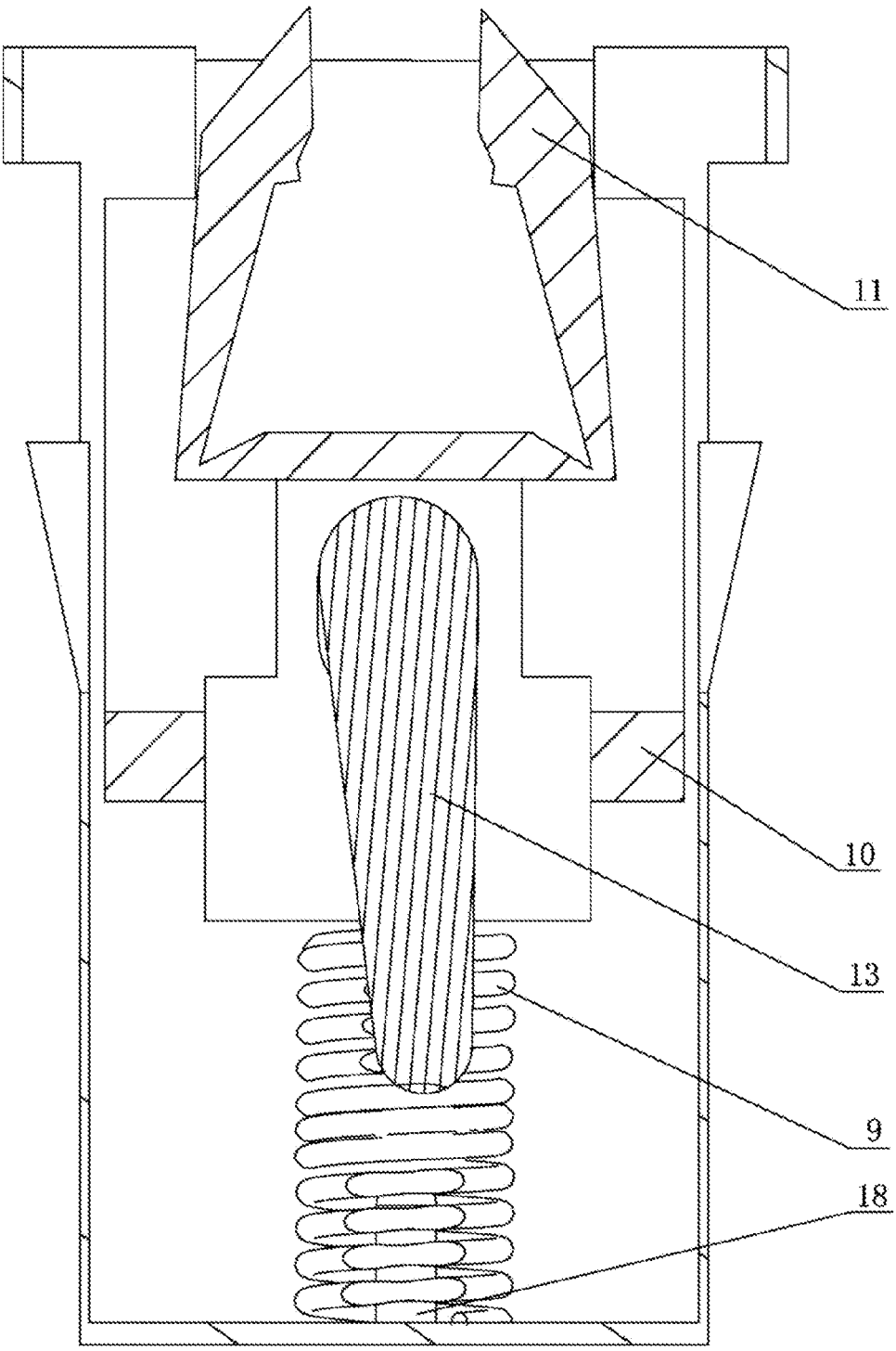
FIG. 7 is a sectional view of the buckle according to the present invention, when the second spring is compressed due to a stress and the combined elastic fastener is located in the inner cavity of the housing.
Figure 8:
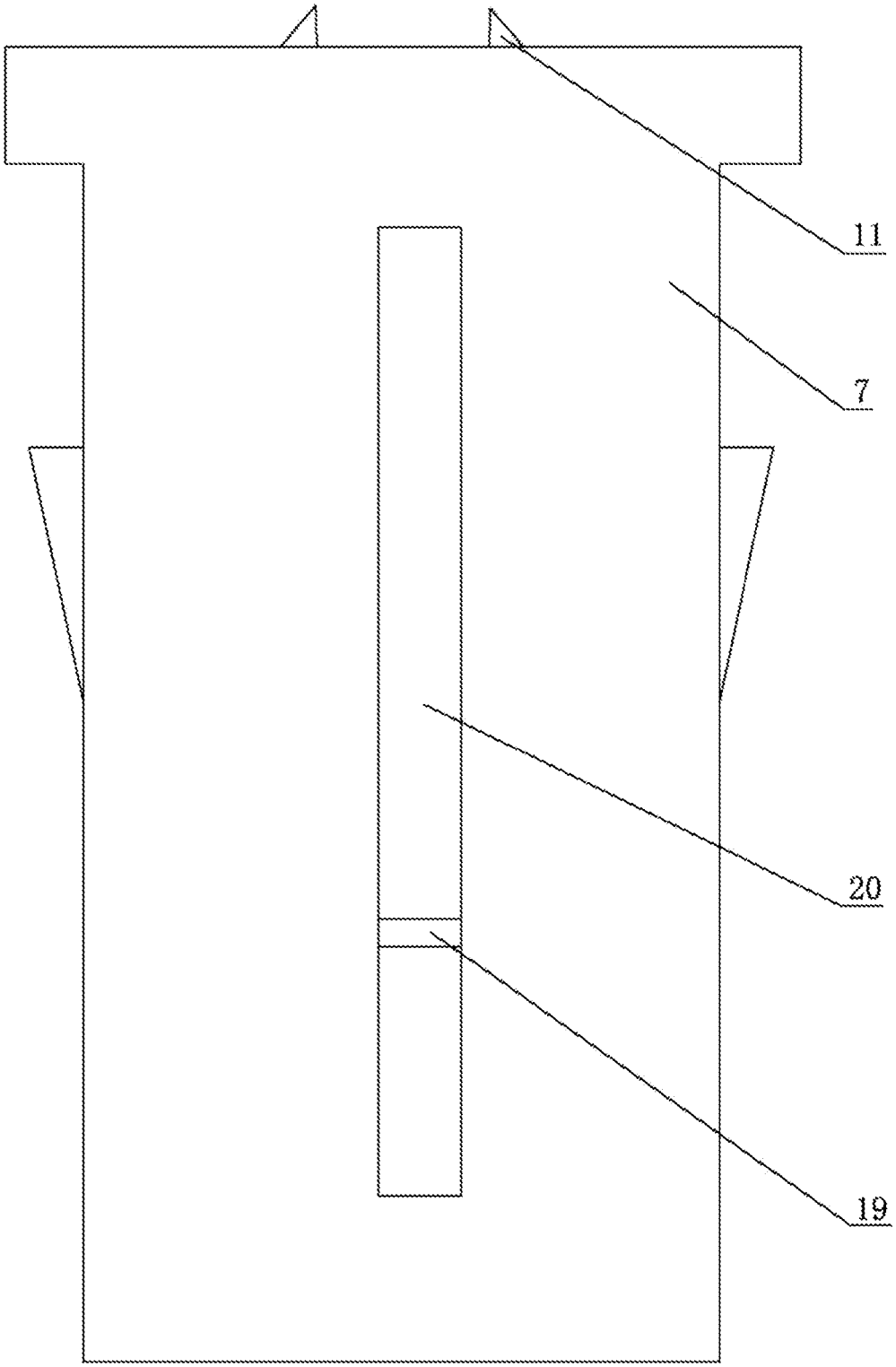
FIG. 8 is a front view of the buckle according to the present invention, when the second spring is compressed due to a stress and the combined elastic fastener is located in the inner cavity of the housing.

As shown in FIGS. 6-7, in the connecting device for light fixtures, a spring positioning column 18, onto which the second spring 9 is sleeved, is disposed on the inner surface of the lower soleplate of the housing. The spring positioning column 18 is used for positioning the second spring 9. As shown in FIG. 8, in the connecting device for light fixtures, a fixture block 19 is disposed on the side of the sliding mounting member 10, a sliding neck 20 is penetrated through the front panel 7 of the housing, and the fixture block 19 is in sliding connection to the sliding neck 20. The fixture block 19 and the sliding neck 20 are arranged to play a role of sliding connection, thereby preventing the second spring 9, the inner combined sliding stopper and the transmission assembly from falling off from the housing. Further, the rear panel 21 provided with the sliding chute 8 and the front panel 7 provided with the sliding neck 20 are parallel to each other.

Figure 5:
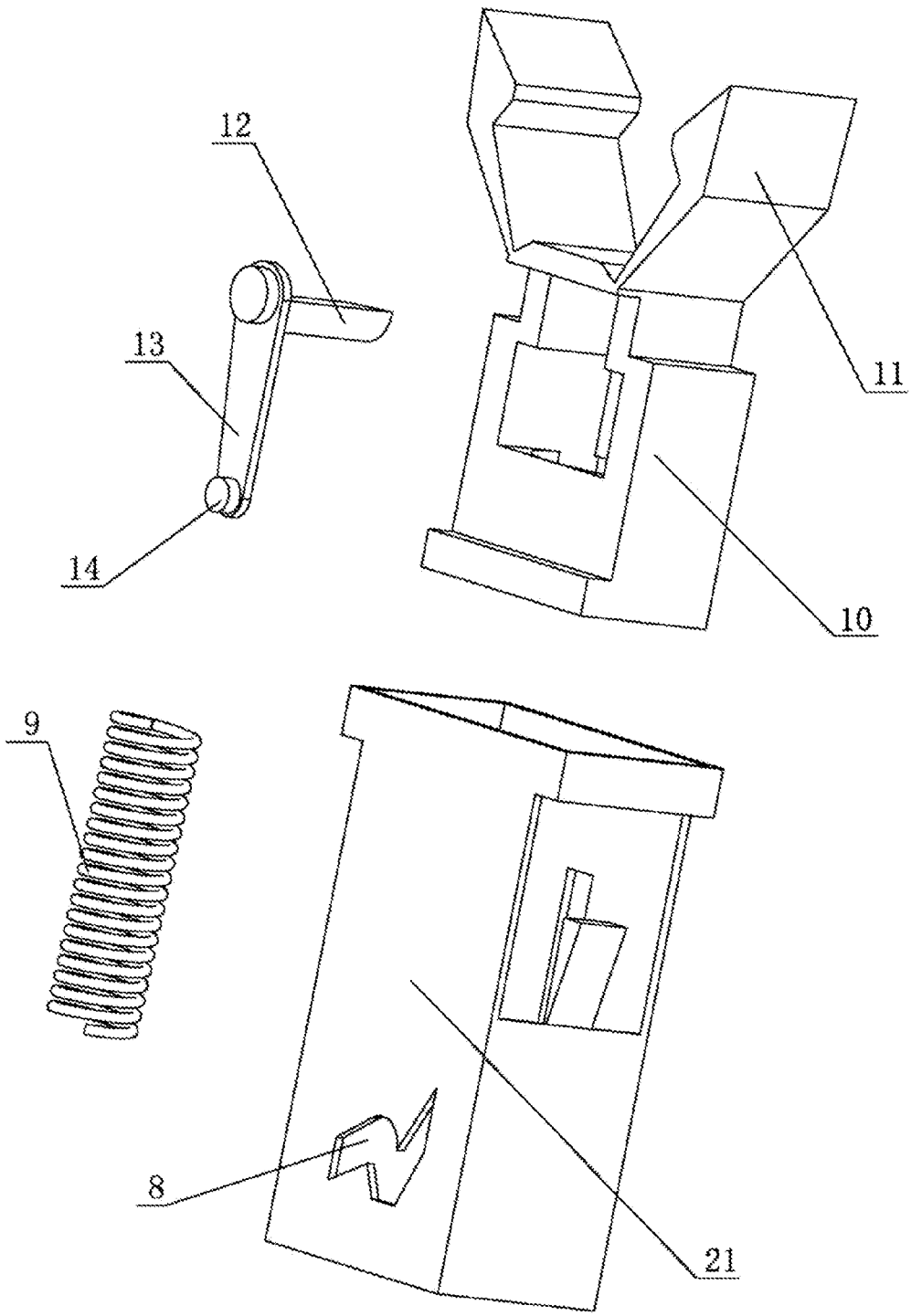
FIG. 5 is an exploded view of a buckle according to the present invention.
Figure 9:
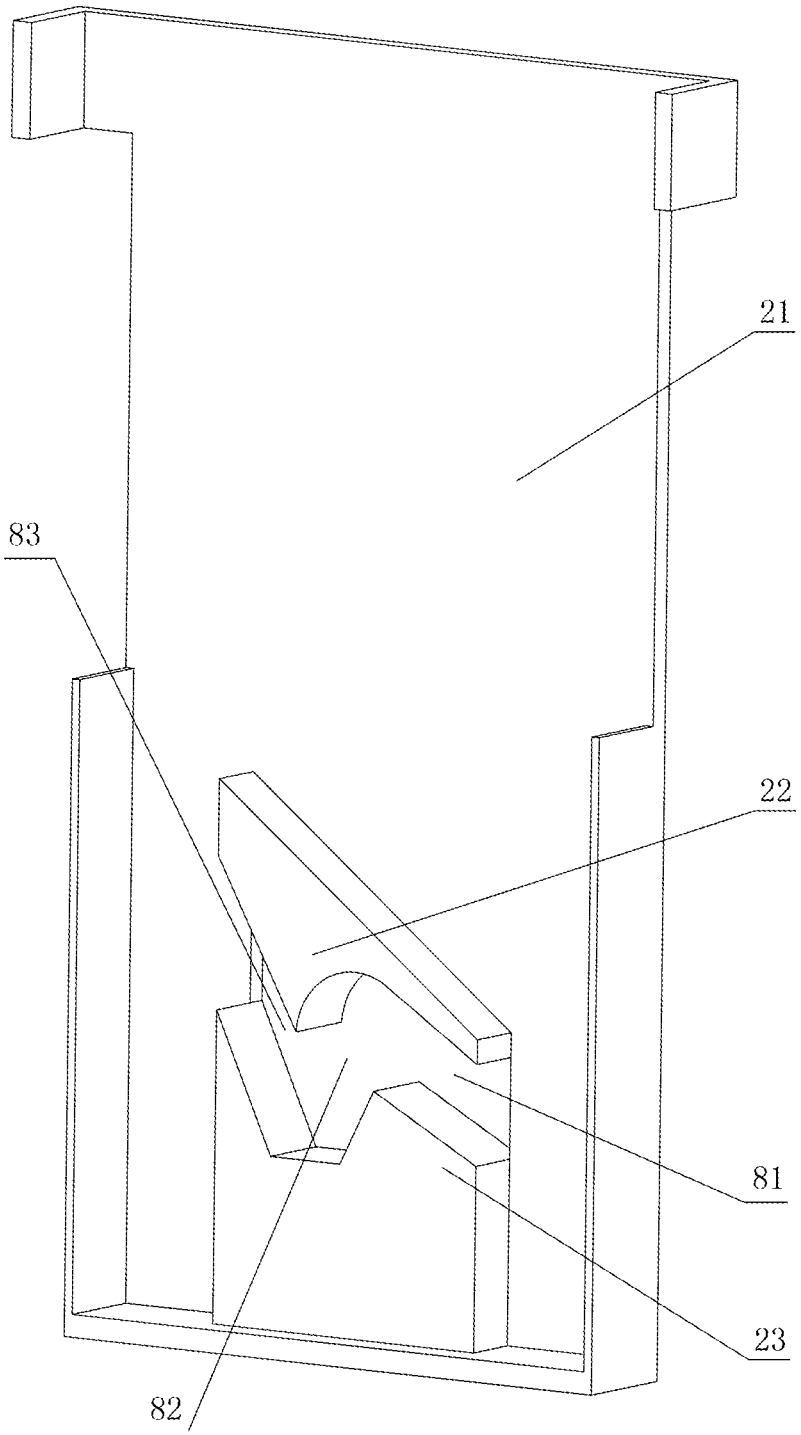
FIG. 9 is a stereoscopic structure diagram of the inner surface of a rear panel according to the present invention.

As shown in FIGS. 5 and 9, in the connecting device for light fixtures, a guide bump 22 playing a role of guiding the sliding handle 14 in the sliding process is disposed on the inner surface of the rear panel 21 of the housing, and the edge of the guide bump 22 is provided with a slope A23 and a slope B24. The guide bump 22 is connected to the sliding chute 8. The slope A23, the sliding chute 8 and the slope B 24 are connected in turn, and the slope B24 is connected to the slope A23. On the inner side of the rear panel 21 of the housing, the guide bump 22 playing a role of guiding and a limiting bump 23 playing a role of limiting are disposed on the sliding chute 8, and the guide bump 22 and the limiting bump 23 are arranged opposite to each other. Further, the sliding chute 8 is in a shape of a hook, including a first bent segment 81, a second bent segment 82 and a third bent segment 83 connected in turn. The shape of the lower edge of the guide bump 22 is the same as that of the upper edge of the sliding chute 8, and the shape of the upper edge of the limiting bump 23 is the same as that of the lower edge of the sliding chute 8. The guide bump 22 plays a role of guiding the sliding of the sliding handle 14, that is to say, due to the curved shape of the guide bump 22, the connecting rod 13 swings around the contact handle 12 along the guide bump 22 under the elasticity of the second spring 9. When the button 3 is pressed down or the first spring 4 and the second spring 9 recover the shape after being compressed, under the elasticity, the sliding handle 14 slides along the periphery of the guide bump 22. When the sliding handle 14 in the sliding process is in contact with the limiting bump 23, the limiting bump 23 enables the sliding handle 14 to slide into the sliding chute 8. When the button 3 is pressed down for the first time (namely, when the lens fixing plate and the light fixture assembly 2 are connected together), the first spring 4 is compressed due to stress; the boss 6 at the front end of the connecting rod 5 is resisted against the combined elastic fastener 11 in the buckle to push the combined elastic fastener 11 into the cavity of the housing, and then the combined elastic fastener 11 pushes the sliding mounting member 10 connected integrally thereto to slide in the inner cavity of the housing. The fixture block 19 slides downwards along a sliding chute 20, and the second spring 9 which is resisted against the contact handle 12 is compressed due to stress; the contact handle 12, the connecting rod 13 and the sliding handle 14 are connected integrally. Therefore, when the sliding mounting member 10 slides back and forth inside the housing, the sliding handle 14 slides downwards along the guide bump 22; when the sliding handle 14 in the sliding process is in contact with the limiting bump 23, the limiting bump 23 enables the sliding handle 14 to slide into the sliding chute 8. Because the sliding chute 8 is in a shape of a hook, and the shape of the lower edge of the guide bump 22 is the same as that of the upper edge of the sliding chute 8, and the shape of the upper edge of the limiting bump 23 is the same as that of the lower edge of the sliding chute 8, the sliding handle 14 slides into the second bent segment 82 and then is clamped to the second bent segment 82 when the button 3 is pressed down for the first time, thereby locking the inner combined sliding stopper. Two fasteners unfolding outside are gradually folded inside during the combined elastic fastener 11 getting into the housing, resulted in clamping the boss 6, namely, in clamping the connecting rod 5. When the button 3 is pressed down for the second time (namely, when the lens fixing plate 1 is dismounted from the light fixture assembly 2), the boss 6 at the front end of the connecting rod 5 is resisted against the combined elastic fastener 11 in the buckle, and the combined elastic fastener 11 pushes the sliding mounting member 10 connected integrally thereto; under the elasticity of the first spring 4 and the second spring 9 recovering the shape after being compressed, the fixture block 19 slides upwards along the sliding chute 20, the sliding handle 14 is retreated from the second bent segment 82 of the sliding chute 8, and slipped out from the sliding chute 8 along the third bent segment 83 to return back to the initial position while the combined elastic fastener 11 is ejected out from the housing; the two fasteners of the combined elastic fastener 11 are unfolded under the elasticity of themselves, and the boss 6 is retreated from the combined elastic fastener 11, namely, the connecting rod 5 is retreated from the buckle, achieving the purpose of dismounting the lens fixing plate 1.

As shown in FIG. 1, further, when the button 3 is pressed down for the first time, the boss 6 is clamped by the combined elastic fastener 11. When the lens fixing plate 1 is to be connected to the light fixture assembly 2, the lens fixing plate 1 is put into the light fixture assembly 2, and the connecting rod 5 is pushed to be fixedly connected to the buckle once the button 3 on the lens fixing plate is pressed down by a hand to; during this process, the boss 6 is clamped by the combined elastic fastener 11 actually. When the lens fixing plate 1 is to be dismounted from the light fixture assembly 2, the connecting rod 5 is pushed by the button 3 and then retreated from the buckle so long as the button 3 on the lens fixing plate 1 is pressed down by a hand (that is, the button 3 is pressed down for the second time), that is, the lens fixing plate is dismounted; during this process, the boss 6 is retreated from the combined elastic fastener 11 actually.

As shown in FIG. 5, the surface of the contact handle 12 resisted against the second spring 9 is a curved surface. The surface of the contact handle 12 resisted against the second spring 9 is curved, enabling the connecting rod 13 to drive the sliding handle 14 to swing around the contact handle 12 along the guide bump 22, that is, when the button 3 is pressed down for the second time (i.e., when the lens fixing plate 1 is to be dismounted from the light fixture assembly 2), the sliding handle 14 is retreated from the second bent segment 82 of the sliding chute 8 and returns back to the initial position along the third bent segment 83 of the sliding chute 8, in order to enable the sliding handle 14 to get into the sliding chute 8 again along the dip direction of the guide bump 22 after the button 3 is pressed down for the next time, thus achieving the purpose of connecting two components (the lens fixing plate 1 and the light fixture assembly 2 in this embodiment). The direction mentioned in this embodiment is subject to FIG. 8, regarding the upward side of the FIG. 8 as the top, the downward side of the FIG. 8 as the bottom, the left side of the FIG. 8 as the left, and the right side of the FIG. 8 as the right.

As shown in FIGS. 1-9, during mounting, when the lens fixing plate 1 is to be connected to the light fixture assembly 2, the lens fixing plate 1 is put into the light fixture assembly 2, and the button 3 on the lens fixing plate is pressed down by a hand, so that the first spring 4 is compressed due to a stress; the boss 6 at the front end of the connecting rod 5 is resisted against the combined elastic fastener 11 in the buckle to push the combined elastic fastener 11 into the housing, and then the combined elastic fastener 11 pushes the sliding mounting member 10 connected integrally thereto to slide in the housing top down. The fixture block 19 slides downwards along a sliding chute 20, and the second spring 9 which is resisted against the contact handle 12 is compressed due to stress; the contact handle 12, the connecting rod 13 and the sliding handle 14 are connected integrally. Therefore, when the sliding mounting member 10 slides back and forth in the housing, the sliding handle 14 slides downwards along the guide bump 22; when the sliding handle 14 in the sliding process is in contact with the limiting bump 23, the limiting bump 23 enables the sliding handle 14 to slide into the sliding chute 8, thereby locking the inner combined sliding stopper. The two fasteners unfolding outside are gradually folded inside during the combined elastic fastener 11 getting into the housing, resulted in clamping the boss 6, namely, in clamping the connecting rod 5. The connecting rod 5 is clamped by the buckle while the lens fixing plate 1 is pushed under the action of the first spring 4 to enable the lenses 15 mounted on the lens fixing plate 1 to be in good and gapless coordination with the LED light sources 16 mounted on the LED light source mounting plate of the light fixture assembly 2, thereby enabling the light fixtures to achieve maximum luminous efficiency. During dismounting, when the lens fixing plate 1 is dismounted from the light fixture assembly 2, the connecting rod 5 can be retreated from the buckle so long as the button 3 on the lens fixing plate 1 is pressed down by a hand to push the connecting rod 5; namely, the lens fixing plate is dismounted. during this process, the boss 6 at the front end of the connecting rod 5 is resisted against the combined elastic fastener 11 in the buckle, and the combined elastic fastener 11 pushes the sliding mounting member 10 connected integrally thereto; under the elasticity of the first spring 4 and the second spring 9 recovering the shape after being compressed, the fixture block 19 slides upwards along the sliding chute 20. Because the contact handle 12 is in a shape of curve, the connecting rod 13 swings around the contact handle 12 along the guide bump 22 under the elasticity of the second spring 9. The sliding handle 14 is retreated from the second bent segment 82 of the sliding chute 8, and returned back to the initial position along the third bent segment 83 of the sliding chute 8, in order to enable the sliding handle 14 to get into the sliding chute 8 again along the dip direction of the guide bump 22 after the button 3 is pressed down for the next time, thus achieving the purpose of connecting two components (the lens fixing plate 1 and the light fixture assembly 2 in this embodiment). The combined elastic fastener 11 is ejected out from the housing; the two fasteners of the combined elastic fastener 11 are unfolded under their own elasticity; and the boss 6 is retreated from the combined elastic fastener 11, that is, the connecting rod 5 is retreated from the buckle, achieving the purpose of dismounting the lens fixing plate 1. The connecting device for light fixtures provided by the embodiment has the advantages of convenient mounting and dismounting processes, simple structure, less production procedures and low production cost, thus promising the manufacturing enterprises with good economic benefits.

The foregoing is just one preferred embodiment of the present invention. Any equivalent changes and modifications made according to the structure, characteristics and principle defined in the scope of the present invention shall fall into the protection scope of the present invention.

What is claimed is:

1. A connecting device for light fixtures, comprising a lens fixing plate (1), a light fixture assembly (2), a button (3), a first spring (4), a connecting rod (5) and a buckle, the buckle being fixedly connected to the light fixture assembly (2); a mounting base (17) being disposed on the lens fixing plate (1), one end of the connecting rod (5) being located in an inner cavity of the mounting base (17) and the other end thereof being extended out from the mounting base (17), the end of the connecting rod (5) extending out from the mounting base (17) being provided with a boss (6), the connecting rod (5) located in the inner cavity of the mounting base (17) being sleeved with the first spring (4), the button (3) being connected to the end of the connecting rod (5) located in the inner cavity of the mounting base (17), one end of the first spring (4) being resisted against the button (3) and the other end thereof being resisted against an end wall of the inner cavity of the mounting base (17); the buckle comprising a housing, a second spring (9), an inner combined sliding stopper and a transmission assembly; the housing comprising a front panel (7), a left side plate, a rear panel (21), a right side plate and a lower soleplate connected integrally; the inner combined sliding stopper being consisted of a sliding mounting member (10) and a combined elastic fastener (11) connected integrally; the transmission assembly comprising a connecting rod (13) provided with a contact handle (12) at one end and a sliding handle (14) at the other end, the contact handle (12) being mounted on the sliding mounting member (10), a sliding chute (8) being penetrated through the rear panel (21) of the housing, the sliding handle (14) being clamped into the sliding chute (8), one end of the second spring (9) being resisted against the contact handle (12) and the other end thereof being resisted against the inner surface of the lower soleplate of the housing; and, the inner combined sliding stopper being able to slide back and forth inside the cavity of the housing through the transmission assembly, the boss (6) being clamped by the combined elastic fastener (11).

2. The connecting device for light fixtures according to claim 1, wherein a spring positioning column (18), onto which the second spring (9) is sleeved, is disposed on the inner surface of the lower soleplate of the housing.

3. The connecting device for light fixtures according to claim 1, wherein a fixture block (19) is disposed on the side of the sliding mounting member (10) and a sliding neck (20) is penetrated through the front panel (7) of the housing, the fixture block (19) is in sliding connection to the sliding neck (20).

4. The connecting device for light fixtures according to claim 1, wherein, on the inner side of the rear panel (21) of the housing, a guide bump (22) playing a role of guiding and a limiting bump (23) playing a role of limiting are disposed on the sliding chute (8), the guide bump (22) and the limiting bump (23) are arranged opposite to each other.

5. The connecting device for light fixtures according to claim 4, wherein the sliding chute (8) is in a shape of a hook, comprising a first bent segment (81), a second bent segment (82) and a third bent segment (83) are connected in turn, the shape of the lower edge of the guide bump (22) is the same as that of the upper edge of the sliding chute (8), the shape of the upper edge of the limiting bump (23) is the same as that of the lower edge of the sliding chute (8).

6. The connecting device for light fixtures according to claim 1, wherein a mounting vacancy is reserved on the sliding mounting member (10), the contact handle (12) is mounted in the mounting vacancy on the sliding mounting member (10), the connecting rod (13) is located between the sliding mounting member (10) and the inner surface of the rear panel (21).

7. The connecting device for light fixtures according to claim 1, wherein the combined elastic fastener (11) consists of two elastic fasteners.

8. The connecting device for light fixtures according to claim 1, wherein the sliding handle (14) is cylindrical.

9. The connecting device for light fixtures according to claim 1, wherein the surface of the contact handle (12) resisted against the second spring (9) is a curved surface.

* * * * *